US009700127B2

(12) United States Patent
Wagstaff

(10) Patent No.: US 9,700,127 B2
(45) Date of Patent: Jul. 11, 2017

(54) TOOTHBRUSH HAVING TUFTED BRISTLES AND TONGUE BRUSH BRISTLES EMANATING FROM THE SAME SURFACE

(71) Applicant: Dr. Bob's Ltd., Springville, UT (US)

(72) Inventor: Robert K. Wagstaff, Springville, UT (US)

(73) Assignee: Dr. Bob's LTD., Springville, UT (US)

( * ) Notice: Subject to any disclaimer, the term of this patent is extended or adjusted under 35 U.S.C. 154(b) by 29 days.

(21) Appl. No.: 14/937,702

(22) Filed: Nov. 10, 2015

(65) Prior Publication Data

US 2017/0127818 A1 May 11, 2017

(51) Int. Cl.
*A46B 9/04* (2006.01)
*A46B 9/06* (2006.01)

(52) U.S. Cl.
CPC ..... *A46B 9/04* (2013.01); *A46B 9/06* (2013.01); *A46B 2200/1066* (2013.01)

(58) Field of Classification Search
CPC ..... A46B 9/005; A46B 9/02; A46B 9/028; A46B 9/04; A46B 9/06; A46B 2200/1066; A46B 15/0081; A46B 3/22; A61B 17/24; A61B 17/244
See application file for complete search history.

(56) References Cited

U.S. PATENT DOCUMENTS

| | | | | |
|---|---|---|---|---|
| 5,896,614 | A * | 4/1999 | Flewitt | A46B 9/005 15/167.1 |
| 6,374,448 | B2 * | 4/2002 | Seifert | A46B 7/08 15/110 |
| 8,332,985 | B2 * | 12/2012 | Solanki | A46B 9/028 15/110 |
| 9,364,303 | B2 * | 6/2016 | Driesen | A61C 17/3436 |
| 9,538,837 | B2 * | 1/2017 | Bartschi | A46B 11/0003 |
| 9,545,148 | B2 * | 1/2017 | Moskovich | A46B 5/0029 |
| 2004/0025275 | A1 * | 2/2004 | Moskovich | A46B 5/0025 15/167.1 |

* cited by examiner

*Primary Examiner* — Shay Karls
(74) *Attorney, Agent, or Firm* — Brian Tucker; Kirton McConkie

(57) ABSTRACT

A toothbrush can include tufted bristles and tongue brush bristles that emanate from the same surface of the head. The tufted bristles can function primarily to clean the teeth whereas the tongue brush bristles can function primarily to clean the surface of the tongue. The tongue brush bristles can also insert between teeth and along the gum line when the toothbrush is used to brush the teeth thereby enhancing the toothbrush's effectiveness for removing bacteria, food particles, and/or soft plaque from the teeth.

18 Claims, 5 Drawing Sheets

TOOTHBRUSH HAVING TUFTED BRISTLES AND TONGUE BRUSH BRISTLES EMANATING FROM THE SAME SURFACE

CROSS-REFERENCE TO RELATED APPLICATIONS

Not Applicable.

BACKGROUND

Toothbrushes typically include tufted bristles because the tufted bristles are effective for cleaning the substantially smooth surface of teeth. Tufted bristles, however, are not effective for cleaning the uneven surface of the tongue since the tufts are incapable of reaching into the crevices where much of the bacteria and food particles are located. For this reason, various tongue cleaning devices have been created. These tongue cleaning devices may include tongue brush bristles and/or a tongue scraper. As opposed to tufted bristles, which are commonly formed of nylon, tongue brush bristles are typically formed of plastic (e.g., polyethylene) or rubber to allow the tongue brush bristles to be formed in various shapes and sizes. The tongue brush bristles are typically pointed and spaced so that the individual bristles can reach into the crevices of the tongue. The flexible pointed bristles of tongue brush bristles are effective in loosening the bacteria and food particles that are present on the soft surface of the tongue. It has been reported that up to 90% of bad breath comes from the tongue so the best way to eliminate bad breath is to remove the cause of bad breath rather than try to cover it up with gum, mints, or mouthwash.

Tongue brush bristles that are formed of plastic and spaced apart are not effective for cleaning the surface of the teeth. Therefore, it is common for an individual to own a toothbrush and a separate tongue cleaning device. However, using two separate devices to clean one's mouth is burdensome. As a result, even if an individual has a toothbrush and a separate tongue cleaning device, the individual is more likely to only use the toothbrush to brush his or her teeth and tongue.

Some manufacturers have attempted to address this problem by incorporating a tongue cleaning surface on the backside of a toothbrush opposite the tufted bristles. With such toothbrushes, the individual can brush his or her teeth using the tufted bristle side of the toothbrush and can then use the tongue cleaning surface on the opposite side of the toothbrush to brush the tongue. This type of tongue cleaning surface, however, is not very effective. Because it is positioned on the opposite side of the toothbrush from the tufted bristles, it is necessary that the tongue cleaning surface not protrude too far from the head of the toothbrush. Otherwise, the tongue cleaning surface would contact the inside of the mouth while the individual is brushing his or her teeth thereby causing discomfort or minimizing the ability to move the toothbrush in a brushing motion. For this reason, the tongue cleaning surface of such toothbrushes is typically configured with a number of rounded rubber bumps that only slightly protrude from the head. These rounded rubber bumps do little to extract the food particles and bacteria from the crevices of the tongue. Accordingly, there are few if any devices available that can be used to effectively clean both the teeth and the tongue.

It is also noted that some toothbrushes have been designed to include tufted bristles as well as gum massagers or stimulators. Typically, these gum massagers or stimulators are formed of rubber and positioned along the periphery of the toothbrush head so that they will contact the gums while the tufted bristles brush the teeth. Because these gum massagers or stimulators are formed of rubber, they lack the rigidity necessary to effectively clean the tongue. Also, the gum massagers or stimulators are typically much too big to reach into the crevices of the tongue. Therefore, if an individual were to use a toothbrush having gum massagers or stimulators to brush his or her tongue, it would not be effective.

BRIEF SUMMARY

The present invention extends to a toothbrush that includes tufted bristles and tongue brush bristles that emanate from the same surface of the head. In this way, the toothbrush can be used to effectively clean both the teeth and the tongue. The tufted bristles can be similar to those of other common toothbrushes. The tongue brush bristles can be formed of a plastic and positioned in a non-tufted (i.e., spaced) configuration. The tongue brush bristles can also have a tapered shape to provide sufficient rigidity to the bristle and to form a point that can reach into the crevices of the tongue.

The tongue brush bristles and tufted bristles can be arranged on the head in a number of different manners. For example, the head may include a section of tongue brush bristles that is positioned at one end or both ends of a section of tufted bristles, that is positioned between two sections of tufted bristles, that surrounds a section of tufted bristles, or that is surrounded by a section of tufted bristles. Similarly, the head may include a number of sections of tongue brush bristles that are interspersed among the tufted bristles in various patterns such as in rows, columns, or a checkboard pattern.

In some embodiments, the tongue brush bristles may be longer than the tufted bristles so that the tips of the tongue brush bristles protrude beyond the tips of the tufted bristles. In this way, the tips of the tongue brush bristles can extend into crevices in the tongue even when the tips of the tufted bristles contact the surface of the tongue. The longer tongue brush bristles may also assist in cleaning the gum line and in removing bacteria, food particles, and or soft plaque from between the teeth when the toothbrush is used to brush the teeth. A toothbrush in accordance with embodiments of the present invention can be a manual or an electric toothbrush.

In one embodiment, the present invention is directed to a toothbrush that includes: a head having a proximal end, a distal end, and a top surface; tufted bristles that emanate from the top surface; and tongue brush bristles that emanate from the top surface.

In another embodiment, the present invention is directed to a toothbrush that includes: a head having a proximal end, a distal end, and a top surface; tufted bristles that emanate from the top surface, the tufted bristles being positioned in an interior of the top surface; and tongue brush bristles that also emanate from the top surface. The tongue brush bristles extend around at least a portion of the periphery of the top surface. Each tongue brush bristle has a base that couples to the head and a tip opposite the base. Each tongue brush bristle is tapered from the base towards the tip such that the tip forms a point. At least some of the tips of the tongue brush bristles extend beyond tips of the tufted bristles.

In another embodiment, the present invention is implemented as a toothbrush that includes: a head having a proximal end, a distal end, and a top surface; one or more sections of tufted bristles that emanate from the top surface; and one or more sections of tongue brush bristles that also emanate from the top surface. The one or more sections of tongue brush bristles are positioned alongside the one or more sections of tufted bristles.

This summary is provided to introduce a selection of concepts in a simplified form that are further described below in the Detailed Description. This Summary is not intended to identify key features or essential features of the claimed subject matter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

In this specification and claims, the term toothbrush should be construed to encompass both manual toothbrushes as well as electric toothbrushes. The head of the toothbrush will be described as being at the distal end of the toothbrush, whereas the handle (or in the case of some electric toothbrushes, the portion of the toothbrush that extends from the head and is configured to connect to a base) will be described as being at the proximal end of the toothbrush. The top surface of the head will refer to the surface of the head from which the tufted bristles emanate.

A tongue brush bristle should be construed as a non-tufted bristle formed of a plastic material (e.g., polyethylene) that has a base that is coupled to the head and a tip opposite the base. The base of a tongue brush bristle is wider than the tip with the tip forming a point. In other words, the width/diameter of a tongue brush bristle tapers from the base to the tip. This tapering gives a tongue brush bristle rigidity at the base and flexibility at the tip so that the pointed tip can insert into crevices in the tongue to remove food particles and bacteria. The flexible pointed tip may also enable the tongue brush bristles to insert between teeth and along the gum line when the toothbrush is used to brush the teeth thereby enhancing the toothbrush's effectiveness for removing bacteria, food particles, and/or soft plaque from the teeth.

As indicated in the background, the tufted bristles are thin strands that are typically formed of nylon and clustered together into tufts. The tufted bristles employed on a toothbrush of the present invention can be similar to any of the tufted bristles commonly used on toothbrushes. In the figures, the tufted bristles are all shown as having substantially the same length. However, in embodiments of the present invention, the tufted bristles can have varying heights as is known in the art.

The head of a toothbrush configured in accordance with the present invention can have any suitable shape and/or size. The tufted bristles can be coupled to the head in any manner known in the art. In some embodiments, the tongue brush bristles can be formed as part of a common base that is embedded within or coupled to the head. For example, the tongue brush bristles and their base can be molded as a single component into the head, or can be molded separately from the head and then coupled to the head using any suitable coupling technique.

Figure 1:
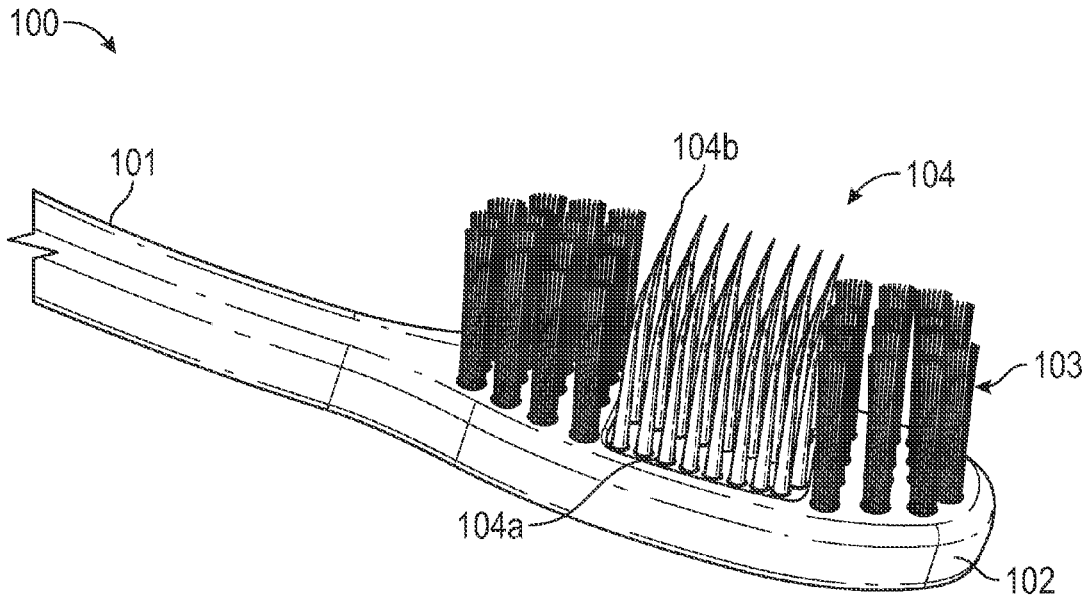
FIG. 1 illustrates an example of a toothbrush that includes a section of tongue brush bristles that is positioned between two sections of tufted bristles.
Figure 1A:
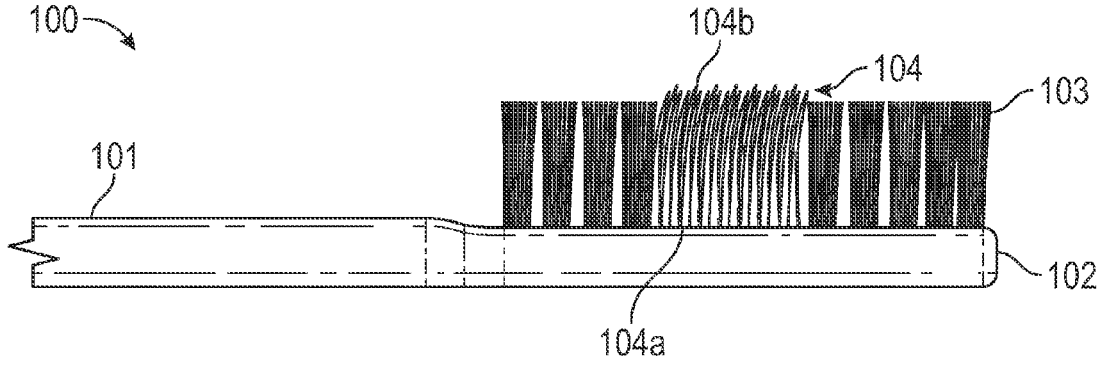
FIG. 1A provides a side view of the toothbrush depicted in FIG. 1 illustrating how the tips of the tongue brush bristles extend beyond the tips of the tufted bristles.
Figure 1B:
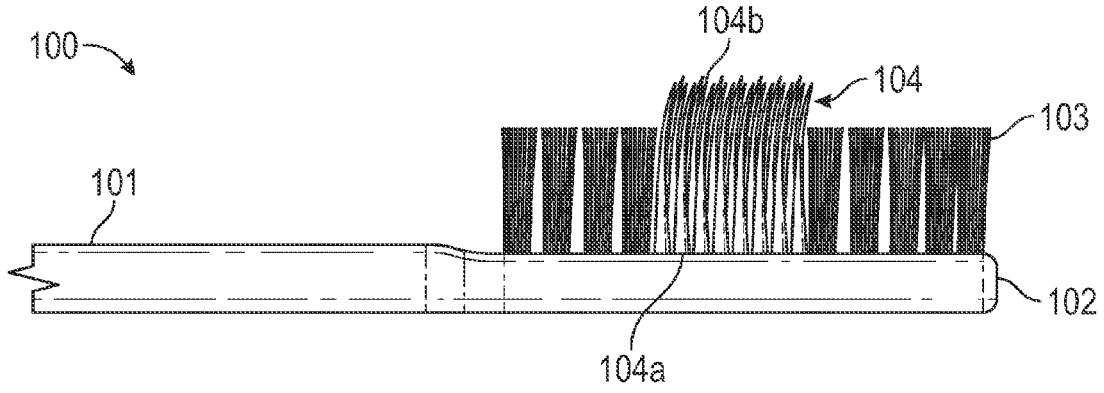
FIG. 1B provides a side view of an alternate configuration of the toothbrush depicted in FIG. 1 in which the tongue brush bristles are longer.

FIGS. 1, 1A, and 1B illustrate an example of a toothbrush 100 that is configured in accordance with one or more embodiments of the present invention. Toothbrush 100 comprises a handle 101 (or alternatively a coupling portion when head 102 is designed for use with an electric toothbrush) and a head 102. Toothbrush 100 also includes both tufted bristles 103 and tongue brush bristles 104 that emanate from the top surface of head 102. Tongue brush bristles include a base 104*a* and a tip 104*b*. Each tongue brush bristle 104 is tapered from its base 104*a* to its tip 104*b* such that tip 104*b* forms a point. In some embodiments, tip 104*b* may be curled as is shown in the figures. However, tip 104*b* may also be straight. Also, although the figures depict tips 104*b* generally curling in the same direction, tips 104*b* may be curled in different directions.

In this embodiment, a section of tongue brush bristles 104 is positioned in between two sections of tufted bristles 103. In other words, a first section of tufted bristles 103 is positioned at a proximal end of head 102, followed by a section of tongue brush bristles 104 at a middle portion of head 102, and then a second section of tufted bristles 103 at the distal end of head 102. Toothbrush 100 can be used in a normal manner to brush the teeth (i.e., by moving the tips of tufted bristles 103 along the surface of the teeth in a brushing fashion). Due to their flexibility, tongue brush bristles 104 will bend back and forth while the teeth are being brushed so as to not hinder the effectiveness of tufted bristles 103. Tongue brush bristles 104 will also provide a small enhancement to the brushing ability of tufted bristles 103, such as, for example, by inserting between teeth and along the gum line to aid in removing food particles and other buildup.

Additionally, toothbrush 100 can be used to brush the surface of the tongue. As described in the background, a toothbrush with tufted bristles alone will not effectively remove food particles and bacteria from the surface of the tongue due to the uneven nature of the surface. However, by incorporating tongue brush bristles 104 onto the same side as tufted bristles 103, toothbrush 100 can effectively clean the surface of the tongue as the pointed tips 104*b* insert into the crevices in the tongue.

In preferred embodiments, tips 104*b* of tongue brush bristles 104 can extend beyond the tips of tufted bristles 103. The amount by which tips 104*b* extend beyond the tips of tufted bristles 103 can be between 0% and 5%, between 5% and 10%, between 10% and 15%, between 15% and 20%, between 20% and 25%, or greater than 25%. For example, FIG. 1A illustrates an example where tongue brush bristles 104 are about 10% longer than tufted bristles 103. FIG. 1B, on the other hand, illustrates an example where tongue brush bristles 104 are about 25% longer than tufted bristles 103. Although the figures illustrate examples where tongue brush bristles 104 have substantially the same length, a toothbrush having tongue brush bristles of varying lengths may also be provided.

In some embodiments, at least some of tufted bristles 103 can have a length between 8 and 9 mm while at least some of tongue brush bristles 104 can have a length between 9 and 11 mm. In other words, tongue brush bristles 104 can preferably be around 10% longer than adjacent tufted bristles 103. Tongue brush bristles 104 can have a base 104*a* (which may be triangular) with a width of approximately 1 mm that tapers to a point at tip 104*b*. Each tongue brush bristle 104 can be spaced from other tongue brush bristles 104 by approximately 1 mm.

Because tongue brush bristles 104 can typically be made of plastic, it is important that they be tapered to a point. Otherwise, tip 104*b* may be too rigid and may irritate the mouth. Also, the pointed tip 104*b* provides the flexibility necessary to reach into crevices, between teeth, along the gums, etc. On the other hand, the tapering also allows base 104*a* to be sufficiently wide to provide the rigidity necessary to prevent tongue brush bristle 104 from flexing so much that tip 104*b* could not easily insert into the crevices, between teeth, along the gums, etc.

It is preferred to have tips 104*b* extend beyond the tips of tufted bristles 103 so that tips 104*b* will be able to easily insert into crevices in the tongue. In particular, while toothbrush 100 is used to brush the tongue, the tips of tufted bristles 103 will contact the outer surface of the tongue thereby limiting the distance between the outer surface of the tongue and head 102. Since tips 104*b* extend beyond the tips of tufted bristles 103, tips 104*b* can still insert into crevices in the outer surface of the tongue to remove food particles and bacteria from the crevices so that they can be spit or flushed from the mouth. However, in some embodiments, at least some of tongue brush bristles 104 may be the same length as or shorter than tufted bristles 103. In such cases, tips 104*b* may still be able to insert into crevices in the tongue's surface as tufted bristles 103 are flexed during the brushing motion.

Because toothbrush 100 includes a section of tongue brush bristles 104 positioned between two sections of tufted bristles 103, tufted bristles 103 still provide a substantial surface area for brushing the teeth. In other words, although tongue brush bristles 104 occupy area on head 102 that would otherwise include tufted bristles 103, the area occupied by tongue brush bristles 104 can be selected so that there are sufficient tufted bristles 103 to adequately clean the teeth and sufficient tongue brush bristles 104 to clean the tongue. Also, because tufted bristles 103 are positioned at the distal and proximal ends of head 102, the brushing motion will ensure that tufted bristles 103 will contact all surfaces of the teeth during brushing. Further, tongue brush bristles 104 can enhance the ability of toothbrush 100 to clean the teeth by inserting between teeth and along the gum line to remove bacteria, food particles, and/or soft plaque that tufted bristles 103 cannot adequately remove.

The arrangement of tufted bristles 103 and tongue brush bristles 104 in toothbrush 100 is just one example. Many other arrangements can also be provided. For example, a section of tufted bristles 103 could be positioned between two sections of tongue brush bristles 104 (i.e., the inverse of the arrangement in toothbrush 100). In such embodiments, the size of the sections of tongue brush bristles 104 could be reduced in comparison to what is shown in FIG. 1 so that the size of the section of tufted bristles 103 would be maximized to ensure an adequate area of tufted bristles for cleaning the teeth.

In FIGS. 2-8, toothbrushes (200, 300, 400, 500, 600, 700, and 800) having different arrangements of tufted bristles (203, 303, 403, 503, 603, 703, and 803) and tongue brush bristles (204, 304, 404, 504, 604, 704, and 804) are shown. Reference signs similar to those used in FIG. 1 are also used in these figures to identify the head and handle of the toothbrush as well as the base and tip of the tongue brush bristles.

Figure 2:
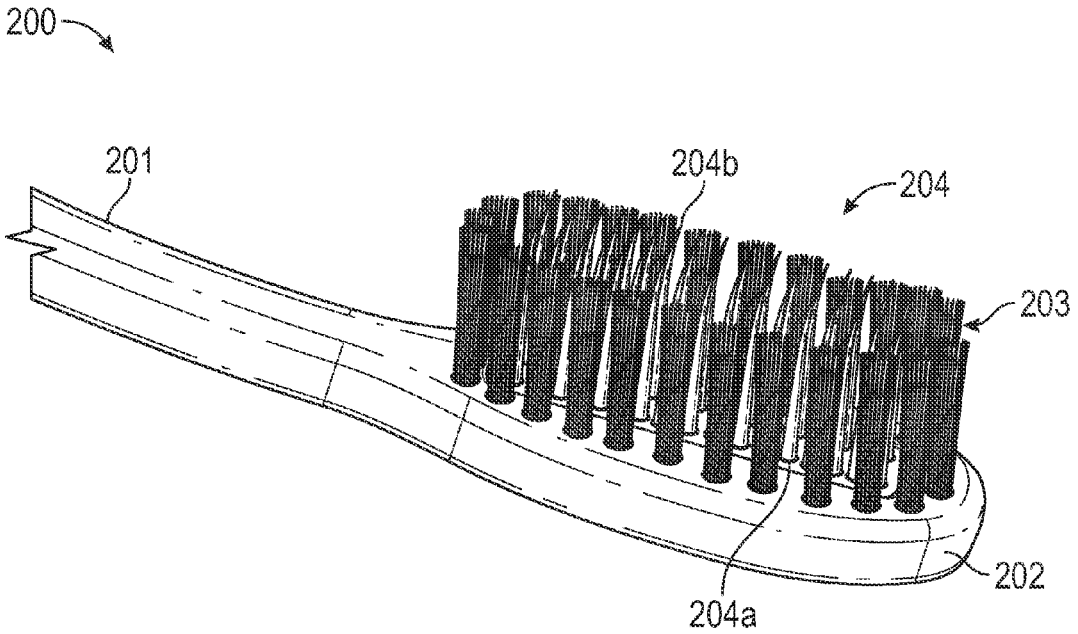
FIG. 2 illustrates an example of a toothbrush that includes a section of tongue brush bristles that is surrounded by tufted bristles.

As shown in FIG. 2, a section of tongue brush bristles 204 can be surrounded by tufted bristles 203. Although FIG. 2 shows that a single row or tufts extends around the periphery of head 202, in some embodiments, multiple rows of tufts may extend around at least a portion of the periphery. Also, the number of tongue brush bristles 204 in this design will depend on a number of factors including the size of head 202, the size of the tufts, the size of the tongue brush bristles, etc. In any case, tongue brush bristles 204 are positioned in the interior of the top surface of head 202 with one or more tufts of tufted bristles 203 positioned towards the outside of head 202.

Figure 3:
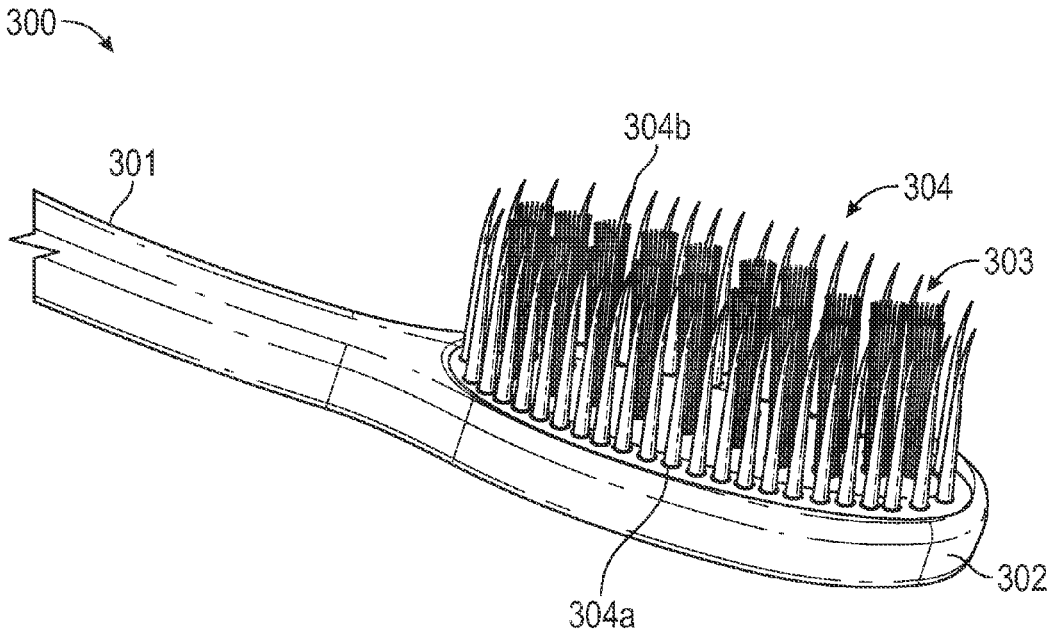
FIG. 3 illustrates an example of a toothbrush that includes a section of tufted bristles that is surrounded by tongue brush bristles.

FIG. 3 illustrates an embodiment of a toothbrush 300 that is substantially the inverse of toothbrush 200. In particular, toothbrush 300 includes a section of tufted bristles 303 that is surrounded by tongue brush bristles 304. In FIG. 3, a single row of tongue brush bristles 304 is shown extending around the periphery of head 302. However, multiple rows of tongue brush bristles 304 could also extend around at a least a portion of the periphery.

In the embodiments depicted in FIGS. 2 and 3, rather than fully surrounding the interior bristles, the tufted or tongue brush bristles could alternatively extend along the sides but not along the proximal and/or distal ends of head 202, 302. In other words, in FIGS. 2 and 3, the tufted bristles 203 and tongue brush bristles 304 respectively could encompass the sides of tongue brush bristles 204 and tufted bristles 303 respectively while not be positioned at the distal and/or proximal ends of head 202, 302.

Figure 4:
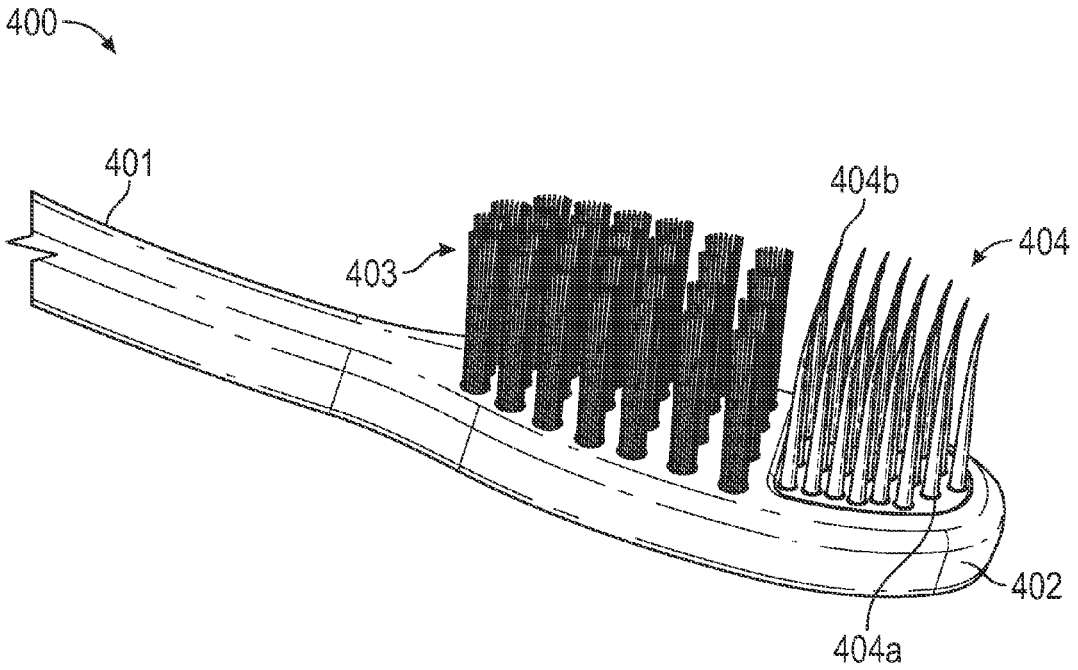
FIG. 4 illustrates an example of a toothbrush that includes a section of tongue brush bristles positioned on a distal side of a section of tufted bristles.
Figure 5:
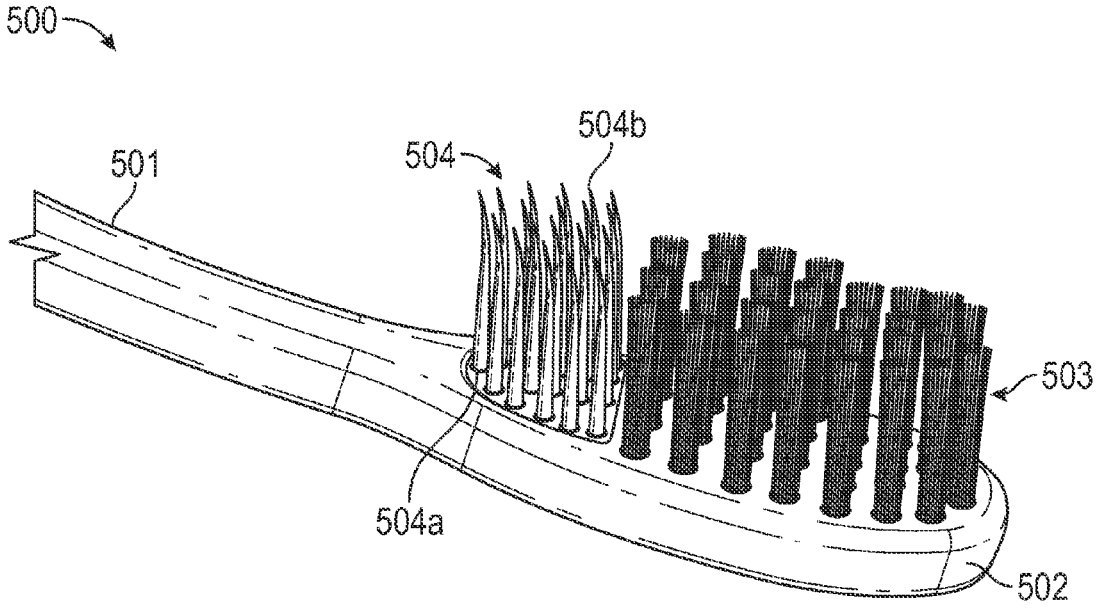
FIG. 5 illustrates an example of a toothbrush that includes a section of tongue brush bristles positioned on a proximal side of a section of tufted bristles.

FIGS. 4 and 5 illustrates examples of toothbrushes 400, 500 where a single section of tongue brush bristles 404, 504 is positioned to the distal and proximal ends respectively of a single section of tufted bristles 403, 503.

Figure 6:
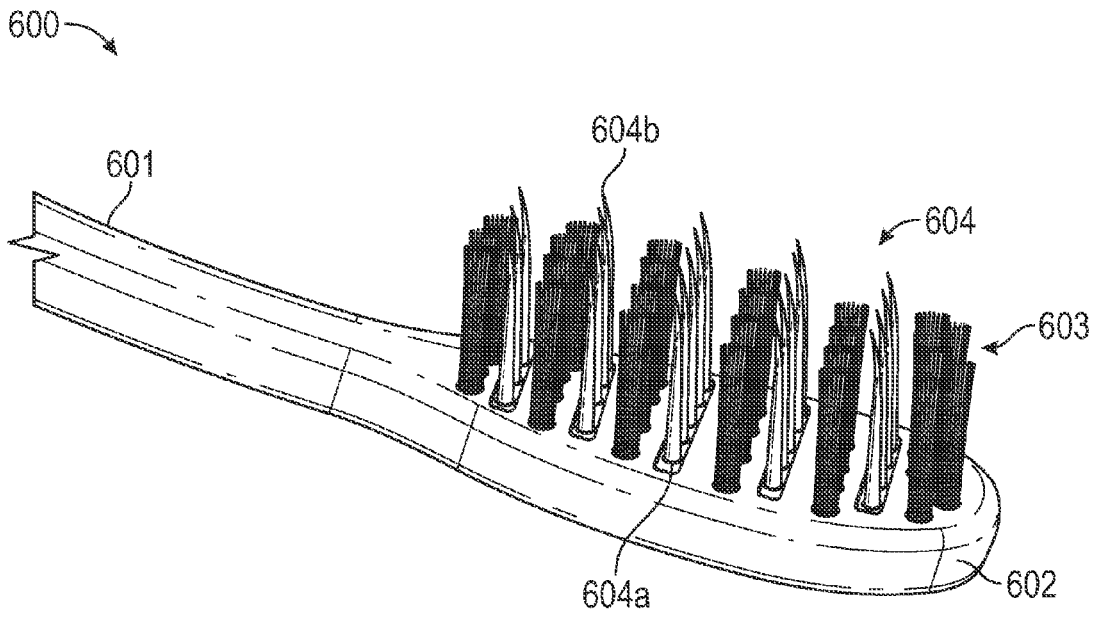
FIG. 6 illustrates an example of a toothbrush that includes rows of tongue brush bristles positioned between rows of tufted bristles.

FIG. 6 illustrates an example of a toothbrush 600 where rows of tufted bristles 603 are alternated with rows of tongue brush bristles 604. Alternatively, multiple rows of tongue brush bristles 604 could be positioned between one or more rows of tufted bristles 603, or one or more rows of tongue brush bristles 604 could be positioned between multiple rows of tufted bristles 603.

Figure 7:
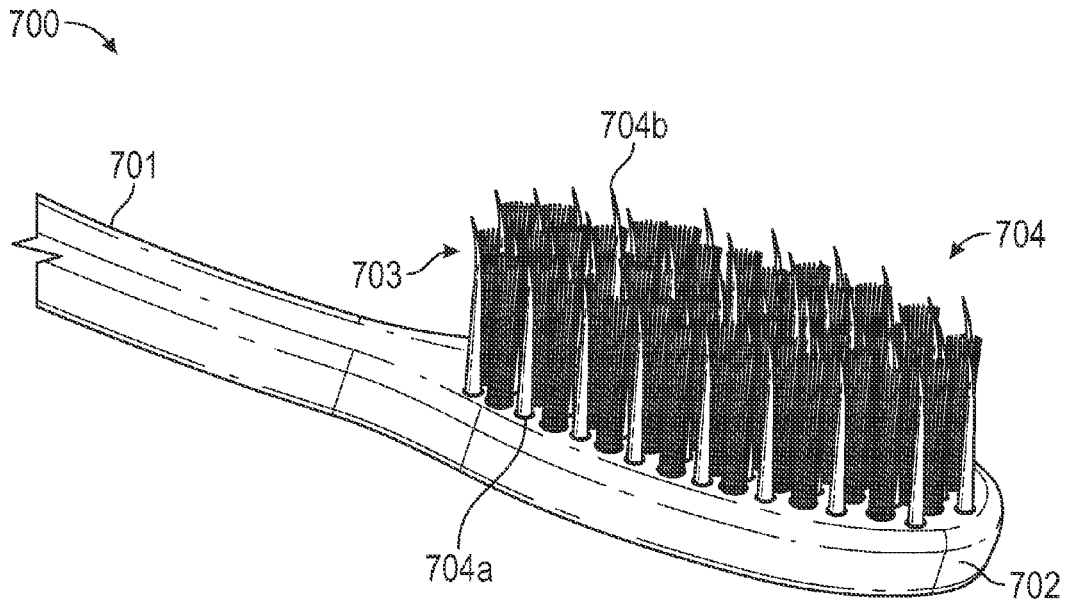
FIG. 7 illustrates an example of a toothbrush that includes tongue brush bristles interspersed among tufted bristles in a checkerboard fashion.

FIG. 7 illustrates an example of a toothbrush 700 where tongue brush bristles 704 are interspersed among tufted bristles 703 in a checkerboard or other pattern. In similar embodiments, clusters of tongue brush bristles 704 could be interspersed among tufted bristles 703.

Figure 8:
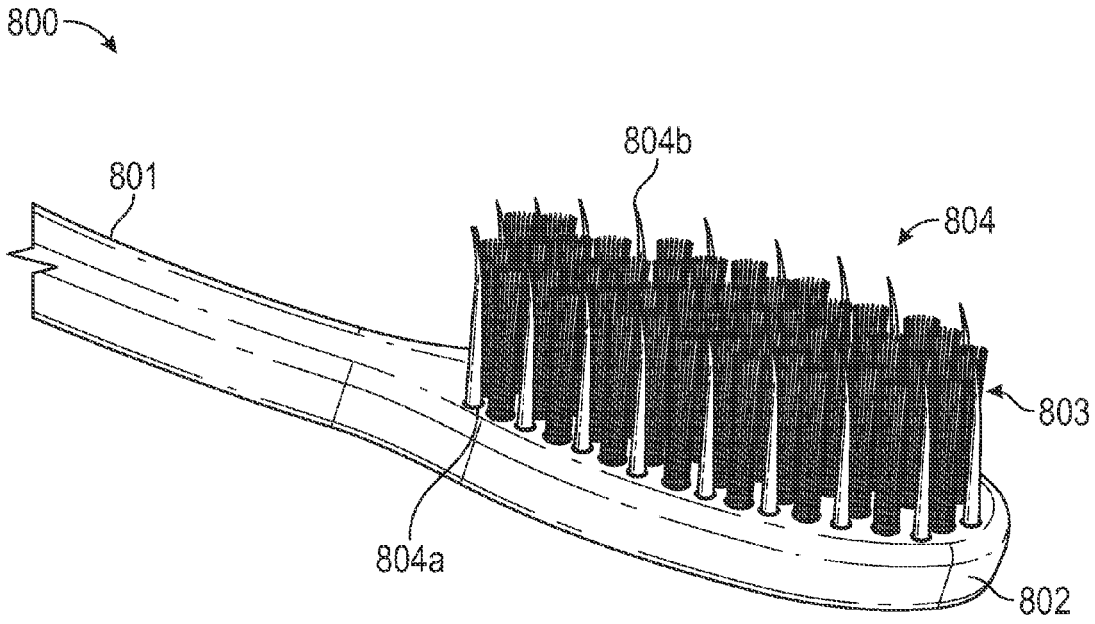
FIG. 8 illustrates an example of a toothbrush that includes tongue brush bristles interspersed among tufted bristles along the periphery of the head of the toothbrush.

FIG. 8 illustrates an example of a toothbrush 800 where tongue brush bristles 804 are interspersed among tufted bristles 803 only along the periphery of head 802. In this embodiment, an alternating pattern of a single tongue brush bristle 604 and a single tuft of tufted bristles 603 is formed along the periphery. Alternatively, an alternating pattern of a cluster of tongue brush bristles 604 and one or more tufts of tufted bristles 603 could be formed along the periphery.

In summary, the present invention provides a toothbrush having tufted bristles and tongue brush bristles that emanate from the same side of the toothbrush's head. In this way, the same side of the head can be used to clean the teeth and the tongue thereby increasing the likelihood that an individual will effectively clean his or her teeth and tongue.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description.

What is claimed:

1. A toothbrush comprising:

a head having a proximal end, a distal end, and a top surface;

tufted bristles that emanate from the top surface; and tongue brush bristles that emanate from the top surface, each tongue brush bristle having a base, a tip, and at least one outer surface that extends from the base to the tip, the at least one outer surface tapering to form a point at the tip that is configured to insert into crevices in the surface of the tongue, the tip of at least some of the tongue brush bristles extending beyond tips of the tufted bristles, the tongue brush bristles being arranged into clusters, each cluster comprising two or more tongue brush bristles, each cluster being interspersed among the tufted bristles.

2. The toothbrush of claim 1, wherein the at least one outer surface comprises three outer surfaces that form a pyramid shape.

3. The toothbrush of claim 1, wherein the at least one outer surface is tapered from the base to the tip.

4. The toothbrush of claim 1, wherein the tufted bristles surround the clusters of tongue brush bristles.

5. The toothbrush of claim 1, wherein the clusters of tongue brush bristles are positioned along a periphery of the top surface.

6. The toothbrush of claim 1, wherein the clusters of tongue brush bristles are positioned in an interior of the top surface.

7. The toothbrush of claim 1, wherein the clusters of tongue brush bristles comprise a distal cluster and a proximal cluster that are positioned on the distal and proximal ends respectively.

8. The toothbrush of claim 1, wherein the clusters of tongue brush bristles comprise a cluster of tongue brush bristles positioned in a middle portion of the top surface.

9. The toothbrush of claim 1, wherein the clusters of tongue brush bristles comprise a cluster of tongue brush bristles positioned at the distal end.

10. The toothbrush of claim 1, wherein the clusters of tongue brush bristles comprise a cluster of tongue brush bristles positioned at the proximal.

11. The toothbrush of claim 1, wherein the tongue brush bristles are formed of polyethylene.

12. The toothbrush of claim 1, wherein the clusters of tongue brush bristles comprise rows of clusters of tongue brush bristles positioned between rows of tufted bristles.

13. A toothbrush comprising:

a head having a proximal end, a distal end, and a top surface;

tufted bristles that emanate from the top surface; and tongue brush bristles that emanate from the top surface, each tongue brush bristle having a base, a tip, and at least one outer surface that extends from the base to the tip, the at least one outer surface tapering to form a point at the tip that is configured to insert into crevices in the surface of the tongue, the tip of at least some of the tongue brush bristles extending beyond tips of the tufted bristles, wherein the tongue brush bristles surround the tufted bristles.

14. A toothbrush comprising:

a head having a proximal end, a distal end, and a top surface;

tufted bristles that emanate from the top surface; and tongue brush bristles, which are formed of polyethylene, that emanate from the top surface, each tongue brush bristle having a base, a tip, and at least one outer surface that extends from the base to the tip, the at least one outer surface tapering to form a point at the tip that is configured to insert into crevices in the surface of the tongue, the tip of at least some of the tongue brush bristles extending beyond tips of the tufted bristles, wherein the tongue brush bristles are interspersed among the tufted bristles only along a periphery of the top surface.

15. A toothbrush comprising:

a head having a proximal end, a distal end, and a top surface;

tufted bristles that emanate from the top surface; and tongue brush bristles that emanate from the top surface, each tongue brush bristle having a base, a tip, and at least one outer surface that extends from the base to the tip, the at least one outer surface tapering to form a point at the tip that is configured to insert into crevices in the surface of the tongue, the tip of at least some of the tongue brush bristles extending beyond tips of the tufted bristles, wherein the tongue brush bristles are interspersed among the tufted bristles, and wherein the interspersed tongue brush bristles comprise interspersed clusters of tongue brush bristles.

16. The toothbrush of claim 15, wherein the interspersed clusters of tongue brush bristles are interspersed only along a periphery of the top surface.

17. A toothbrush comprising:

a head having a proximal end, a distal end, and a top surface;

tufted bristles that emanate from the top surface, the tufted bristles being positioned in an interior of the top surface; and tongue brush bristles that also emanate from the top surface, the tongue brush bristles extending around at least a portion of the periphery of the top surface, each tongue brush bristle having a general pyramid shape formed by a base that couples to the head, a tip opposite the base, and outer surfaces that extend from the base to the tip and taper to form a point at the tip that is configured to insert into crevices in the surface of the tongue, at least some of the tips of the tongue brush bristles extending beyond tips of the tufted bristles, the tongue brush bristles being arranged into clusters, each cluster comprising two or more tongue brush bristles, each cluster being interspersed among the tufted bristles.

18. A toothbrush comprising:

a head having a proximal end, a distal end, and a top surface;

tufted bristles that emanate from the top surface; and clusters of tongue brush bristles that also emanate from the top surface, the clusters of tongue brush bristles being interspersed among the tufted bristles, each tongue brush bristle being formed of polyethylene and having a base, a tip, and at least one outer surface that extends from the base to the tip, each of the at least one outer surface tapering to form a point at the tip that is configured to insert into crevices in the surface of the tongue, the tip of at least some of the tongue brush bristles extending beyond tips of the tufted bristles.

* * * * *